US008920290B2

(12) United States Patent
Stokes et al.

(10) Patent No.: US 8,920,290 B2
(45) Date of Patent: Dec. 30, 2014

(54) APPARATUS, SYSTEM, AND METHOD FOR A TRAMPOLINE

(76) Inventors: Steven G. Stokes, Smithfield, UT (US); Michael H. Morrill, Logan, UT (US); Nathanael Andersen, Logan, UT (US)

( * ) Notice: Subject to any disclaimer, the term of this patent is extended or adjusted under 35 U.S.C. 154(b) by 264 days.

(21) Appl. No.: 13/471,328

(22) Filed: May 14, 2012

(65) Prior Publication Data

US 2012/0289379 A1 Nov. 15, 2012

Related U.S. Application Data

(60) Provisional application No. 61/486,089, filed on May 13, 2011.

(51) Int. Cl.

| | |
|---|---|
| ***A63B 21/00*** | (2006.01) |
| ***A63B 71/00*** | (2006.01) |
| ***A63B 5/11*** | (2006.01) |
| *A63B 71/02* | (2006.01) |

(52) U.S. Cl.

CPC ..... *A63B 5/11* (2013.01); *A63B 2071/024* (2013.01); *A63B 71/022* (2013.01); *A63B 71/0036* (2013.01); *A63B 2210/50* (2013.01)

USPC ..... 482/27

(58) Field of Classification Search

USPC ..... 482/27, 28

See application file for complete search history.

(56) References Cited

U.S. PATENT DOCUMENTS

| | | | | |
|---|---|---|---|---|
| 4,433,838 | A | 2/1984 | Gordon | |
| D350,310 | S * | 9/1994 | Willis et al. | D11/181 |
| 5,399,132 | A | 3/1995 | Bailey | |
| 5,941,798 | A | 8/1999 | Coan et al. | |
| 6,053,845 | A | 4/2000 | Publicover et al. | |
| 6,129,649 | A | 10/2000 | Yang | |
| 6,607,468 | B1 | 8/2003 | Nichols, Jr. et al. | |
| D536,405 | S | 2/2007 | Freeman | |
| 7,481,740 | B2 | 1/2009 | Colling | |
| 7,494,444 | B2 | 2/2009 | Adams | |
| 7,708,667 | B2 | 5/2010 | Alexander | |
| 7,713,174 | B2 | 5/2010 | Xiang | |
| 7,758,471 | B2 | 7/2010 | Nelson | |
| 7,766,795 | B2 | 8/2010 | Publicover | |
| 7,794,360 | B2 * | 9/2010 | Publicover | 482/27 |
| 7,850,575 | B1 * | 12/2010 | Hsiang | 482/27 |
| D630,285 | S | 1/2011 | Hsiang | |
| 7,927,255 | B2 | 4/2011 | Publicover et al. | |
| 2002/0137598 | A1 | 9/2002 | Publicover et al. | |
| 2004/0121883 | A1 | 6/2004 | Publicover | |
| 2006/0270524 | A1 | 11/2006 | Colling | |
| 2008/0314427 | A1 | 12/2008 | Lai | |
| 2009/0062078 | A1 | 3/2009 | VanElverdinghe | |
| 2010/0273611 | A1 | 10/2010 | Publicover | |

* cited by examiner

*Primary Examiner* — Jerome W Donnelly

(74) *Attorney, Agent, or Firm* — Kunzler Law Group

(57) ABSTRACT

An apparatus, system, and method for attaching a trampoline enclosure net to an enclosure pole involves attaching the enclosure net directly to the top end of the enclosure pole with an elastic cord. The enclosure pole may curve outward from the trampoline. The enclosure pole may pass through an opening in a protective pad to prevent the protective pad from moving out of place. The entire trampoline may be densely packaged for easy storage and shipping.

20 Claims, 12 Drawing Sheets

APPARATUS, SYSTEM, AND METHOD FOR A TRAMPOLINE

CROSS-REFERENCES TO RELATED APPLICATIONS

This application claims the benefit of U.S. Provisional Patent Application No. 61/486,089 entitled "Apparatus, System, and Method for a Trampoline" and filed on May 13, 2011 for Steven G. Stokes et al., which is incorporated herein by reference.

FIELD

The present invention relates to trampoline enclosures and the packaging of trampolines. More specifically, the present invention relates to an apparatus, system, and method for attaching a trampoline enclosure to an enclosure pole and densely packaging a trampoline system in a container.

BACKGROUND

Trampoline enclosures are structures that surround a trampoline mat to protect jumpers from accidents resulting from falling off the trampoline or colliding with the frame or springs. Currently available enclosures are supported by a series of upright enclosure poles that attach to the outside of the trampoline frame and extend straight up. The enclosure net is usually attached to the enclosure pole by an upper steel top-rail. The disadvantage of this type of attachment is that it can be difficult and tedious to put together the upper top-rail and attach it to the enclosure poles. Also, two or more individuals are typically required to install the enclosure properly.

Further, the current means of attaching an enclosure net to a trampoline involves the attachment of the enclosure net to a series of upright enclosure poles that are attached to the exterior of the trampoline frame. There are several disadvantages to having enclosure poles that attach to the exterior of the frame. For example, the enclosure poles attached to the exterior of the frame could cause injury to adults, children, or pets who may be walking or playing around the trampoline. Moreover, this type of attachment typically requires enclosure poles to be attached to every leg support to keep the net taut, which requires additional parts and tedious work for each additional enclosure pole.

Additionally, the current methods to package and ship a trampoline are burdensome due to the awkward shape of the component parts. The component parts of a trampoline are typically shipped in large containers and are arranged in such a way as to create gaps of empty space inside the box. This causes the containers to be larger than necessary, making the containers difficult to handle and expensive to store and ship. Some current configurations require the trampoline and the enclosure to be packaged in separate containers, making it even more burdensome and expensive to handle and ship.

Consequently, a need exists to for an enclosure net that can be easily and quickly attached to a trampoline. Further, a need exists to protect the safety of those that are present around the exterior of the trampoline by moving the enclosure poles from the exterior of the trampoline while also reducing the number or enclosure poles required and reducing the number of parts required to attach the enclosure poles. Finally, a need exists to improve the packaging of trampoline component parts to make the trampoline containers smaller, easier to handle, and less expensive to store and ship.

SUMMARY

The apparatus of the present invention has been developed in response to the current state of the art. More specifically, the present invention has solved a number of problems with the present art that have yet to be fully solved regarding trampoline enclosure systems and trampoline packaging methods. The present invention is drawn to an apparatus, system, and method of attaching a trampoline enclosure net to enclosure poles attached to a trampoline frame. Certain embodiments of the trampoline enclosure include a plurality of elastic cords attached to the top of the enclosure net. The trampoline frame includes a plurality of enclosure poles attached to the frame, which are disconnectable in such a way as to make packaging of the trampoline more efficient.

The upright enclosure poles consist of a bottom end and a top end. The top end of the enclosure poles have a connecting mechanism, such as an eyebolt or other connecting means whereby an elastic cord attached to the enclosure net can be coupled to the enclosure pole. This arrangement keeps the enclosure net taut even when a person jumping on the trampoline engages the net.

The enclosure poles may be attached to the trampoline frame by a three-way bracket, which has openings for an enclosure pole, a leg support, and a plurality of the frame tubes. The bracket in one embodiment has a square shaped opening for receiving a tapered or square shaped male connector on the bottom end of the enclosure pole. This maintains alignment of the enclosure pole ensuring the enclosure net stays taut.

To attach to the bracket, the enclosure poles may pass through an opening in the protective pad that covers the springs and helps prevent injuries caused by the springs or the openings between the springs. The enclosure pole has a diameter larger than the opening in the protective pad, which allows the enclosure pole to hold the protective pad in place, restricting it from moving when the trampoline is used.

The bracket also allows the enclosure poles in one embodiment to be situated on the interior of the curved trampoline frame. This reduces the number of parts needed to set up the enclosure and also increases the safety of those on the exterior of the trampoline. In order to ensure that the enclosure net stays taut with the enclosure poles on the interior of the frame, the enclosure poles in one embodiment curve outward. The curve in the enclosure poles may, for example, be a gradual curve or have a dogleg bend that also bends towards the exterior of the trampoline frame. This configuration also allows for the use of an odd number of enclosure poles, instead of requiring an enclosure pole to be attached to every leg support as found in the present art.

The enclosure poles may disconnect in the middle, creating two smaller poles. Having two smaller pieces that constitute the enclosure pole enables the trampoline to be densely packaged in a smaller container. The trampoline components are divided into layers inside the container. The bottom and intermediate layers are comprised of the enclosure poles and frame tubes. The top layer comprises the leg supports encircling the soft components such as the rebounding mat, enclosure net, and protective pad. A smaller container allows easier and less expensive handling, storage, and shipment of the trampoline.

Attaching the enclosure net to the enclosure poles by using an elastic cord is a quick and effective method of attaching the enclosure net to the enclosure poles. Additionally, the curvature of the enclosure poles allows the net to stay taut while requiring fewer parts to set up the enclosure net. Further, moving the enclosure poles to the interior of the trampoline frame increases the safety of those on the exterior of the trampoline. Finally, the design of the component parts allows the trampoline to be densely packaged in a container that is easy to handle, store, and ship.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
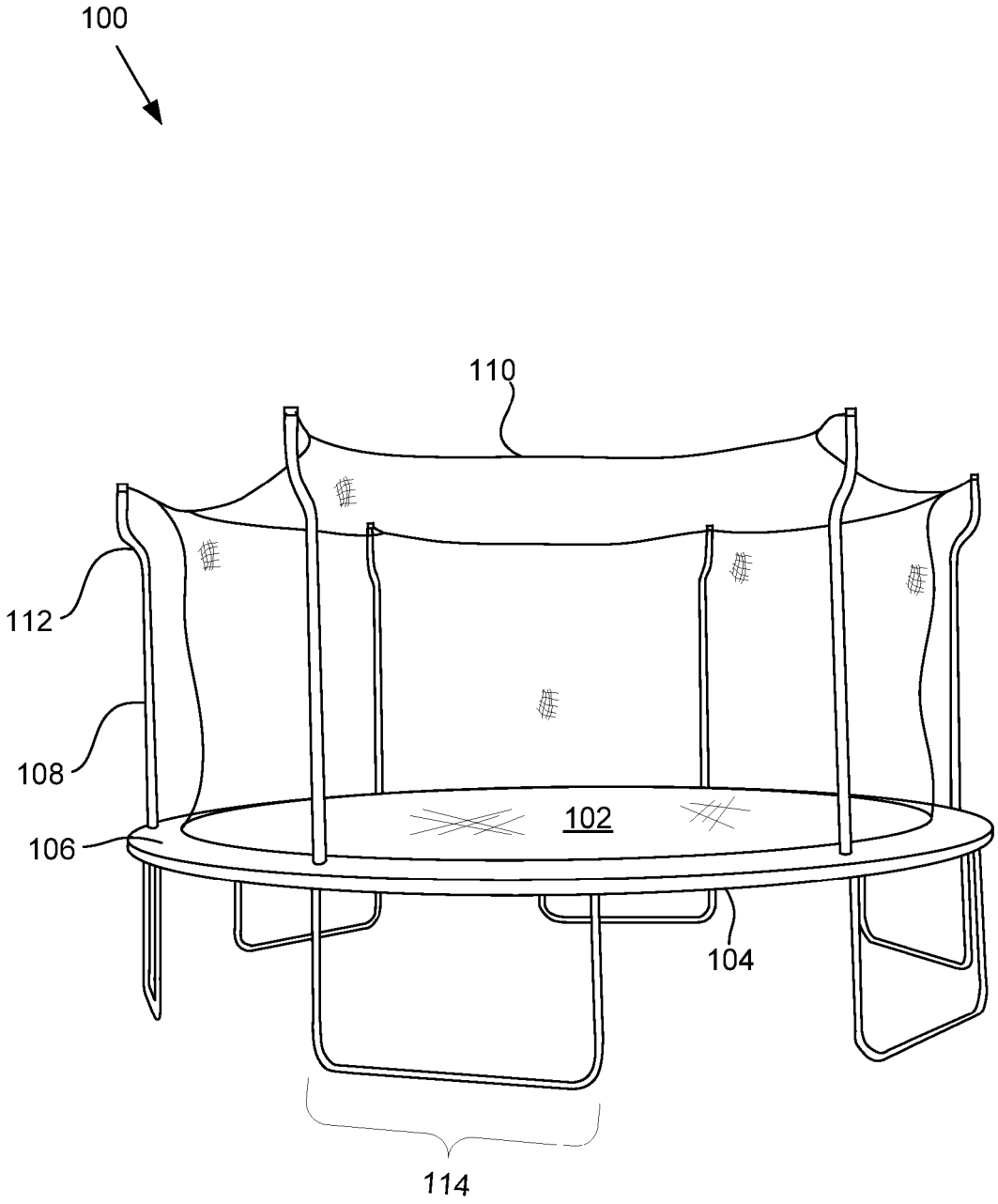
FIG. 1 is a perspective view illustrating one embodiment of a trampoline in accordance with the present invention.

FIG. 1 depicts a trampoline system 100. The trampoline system (hereinafter "system") 100 includes a rebounding mat 102 stretched and maintained inside the perimeter of a frame 104 by springs (not shown). The depicted embodiment illustrates a generally circular frame 104, which may have a diameter in the range of between about 3 and 20 feet, however, the frame 104 may be formed in alternative shapes including, but not limited to, squares, rectangles, octagons, etc. Correspondingly, the rebounding mat 102 may also be formed having a shape that conforms to the shape of the frame 104.

The quantity of springs is selected according to the size of the frame 104 and mat 102. For example, a system 100 having a frame 104 with a 12 foot diameter may have in the range of between about 60 and 90 springs, while a system 100 having a frame 104 with a 15 foot diameter may have in the range of between about 90 and 120 springs. The number of springs determines the ability of the mat 102 to rebound, or accelerate a person that is jumping on the mat 102. In other words, the number of springs helps determine how high a person will be able to jump.

In one embodiment, a protective pad 106 covers the springs that attach the mat 102 to the frame 104, and protects the person jumping on the system 100 by preventing the person from falling into the springs between the mat 102 and the frame 104. Generally, trampoline manufacturers provide pads that tie to the frame on one side of the pad, and the springs on the other side of the pad. However, this is problematic because as a person jumps, the ties become loose or rip from the mat. The system 100 overcomes this by utilizing enclosure poles 108 that secure the pad 106 to the frame 104.

The enclosure poles 108, in one embodiment, connect to a bracket on the inside of the frame 104. To accomplish this, the enclosure poles 108 pass through the pad 106 before inserting into the bracket. As such, the enclosure poles 108 maintain the pad 106 in position over the springs without the need of ties or other attachment mechanisms. The bracket will be discussed in greater detail below with reference to FIGS. 2 and 3.

Typically, trampoline manufacturers mount the enclosure pole to the outside of the frame 104 to move the enclosure pole away from the person jumping, and also to maintain the tightness of an enclosure. In other words, to keep the enclosure tight, and prevent sagging, enclosure poles are typically mounted to the outside of the frame to better stretch the enclosure. However, this requires that the enclosure poles of the typical trampoline are on the outside of the frame where they can cause an injury to people walking around the trampoline or children playing near the outside of the frame. The enclosure poles 108 in the depicted embodiment, however, are configured with an offset 112 to allow the enclosure pole 108 to be mounted inside the frame 104 while still stretching an enclosure 110 sufficiently. Beneficially, mounting the enclosure pole 108 inside the frame 104 also protects adults, children, and pets that may be playing or walking around the system 100 from becoming injured on an enclosure pole 108 that protrudes from the frame 104.

The frame 104 is supported by multiple leg supports 114. The number of leg supports 114 may be determined according to the diameter of the frame 104. In one example, the number of leg supports 114 is in the range of between about 4 and 6. For example, with a frame diameter of 15 feet, the number of leg supports 114 is 6. The system 100, as depicted, includes one enclosure support 108 per leg support 114. Alternatively, the system 100 may include any number of enclosure supports 108 as is necessary to maintain the enclosure 110.

Figure 2:
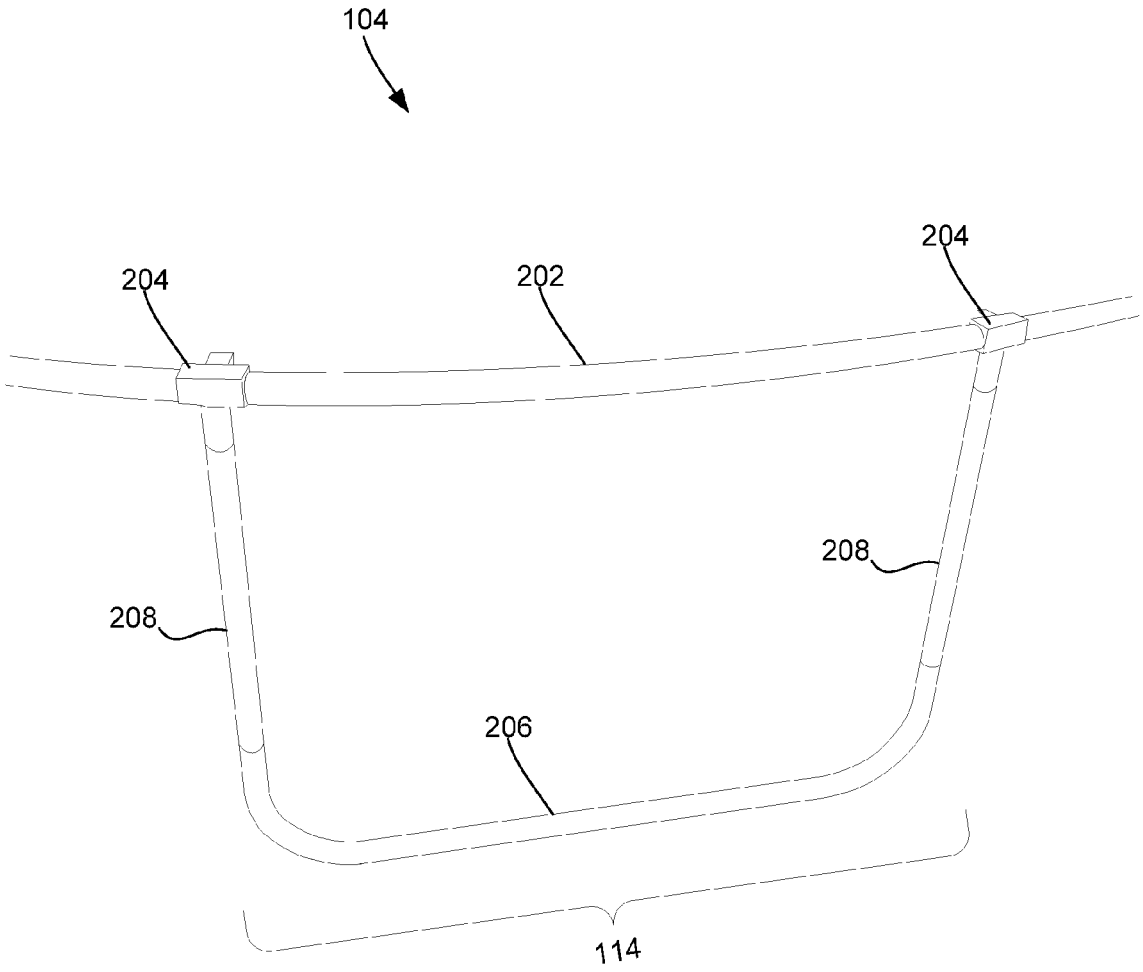
FIG. 2 is a perspective view illustrating a portion of a trampoline frame.

FIG. 2 is a perspective view diagram illustrating one embodiment of a portion of the frame 104. The frame 104, in one embodiment, is formed of a plurality of curved tubes 202, where each of the curved tubes 202 form a portion of the substantially circular frame 104 as depicted in FIG. 1. Each of the curved tubes is formed having substantially equivalent lengths. In a further example, each curved tube 202 is identical to an adjacent curved tube 202 in shape and length. The curved tubes 202 are formed of a substantially rigid material capable of supporting a person while jumping on the mat. In one embodiment, the rigid material is steel.

The curved tubes 202 are formed having a male portion that inserts into a bracket 204. The male portion of the curved tubes 202 and the corresponding female portion of the bracket 204, in one embodiment, are square so as to prevent rotation of the curved tubes 202 with reference to the bracket 204. FIG. 2 also illustrates the leg support 114. The leg support 114 may also be formed of steel like the curved tubes 202. The leg support 114, in one embodiment, comprises u-shaped, ground-engaging, leg center tube 206 that is connectable with straight leg tubes 208.

In one example, the leg center tube 206 is formed having a generally u-shaped profile, with two opening for receiving the straight leg tubes 208. The straight leg tubes 208, for ease of manufacture, are formed having circular male portions at each end for inserting into either the bracket 204 or the leg center tube 206. Due to the symmetrical nature of the straight leg tubes 208, assembly of the trampoline 100 of FIG. 1 is easier, as a person does not have to concern oneself about the correct orientation of the straight leg tubes 208. Alternatively, and in a manner similar to the curved tubes 202, the straight leg tubes 208 may be formed having square male portions for inserting into the bracket 204.

Each bracket 204 is configured to receive, in one embodiment, four tubes or poles. These tubes include two curved tubes 202, one straight leg tube 208, and one enclosure pole 108 of FIG. 1. The bracket 204 will be described in greater detail below with reference to FIG. 3.

Figure 3:
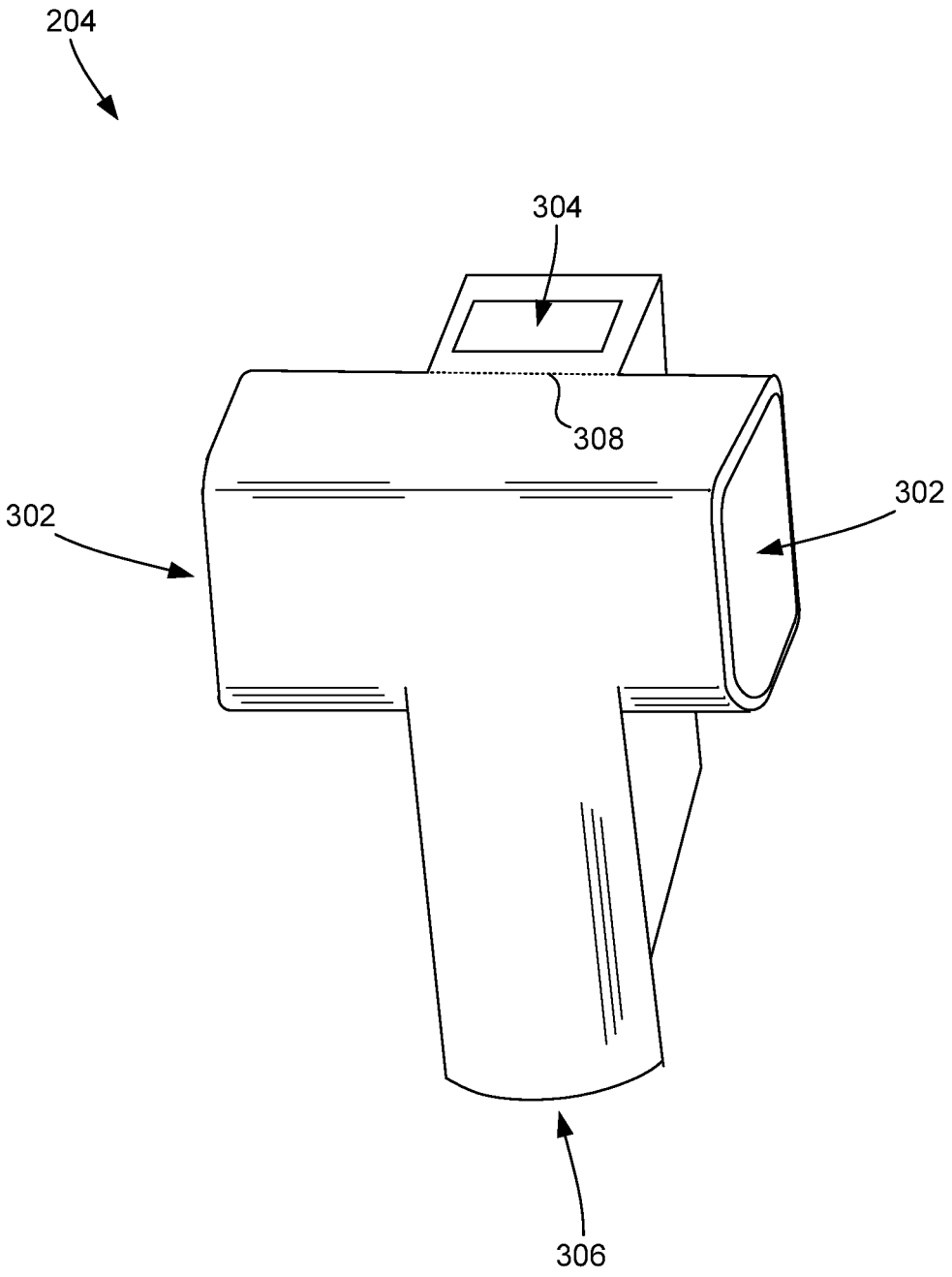
FIG. 3 is a perspective view illustrating one embodiment of a trampoline frame bracket.

FIG. 3 is a perspective view diagram illustrating one embodiment of a bracket 204. The bracket 204, as described above, is configured to receive four tubes, including two curved tubes 202, the straight leg tube 208, and the enclosure pole 108 described above with reference to FIGS. 1 and 2. The bracket 204 may be formed having square openings 302, 304 for the curved tubes 202 and the enclosure pole 108, and a round opening 306 for the straight leg tubes 208. The bracket 204 is formed of a substantially rigid material capable of supporting the trampoline system 100. In one example, this substantially rigid material is a metal such as steel.

The bracket 204 may be formed as one unitary piece. In other words, the bracket 204 may be cast from a single mold. Alternatively, the bracket 204 may be formed of separate pieces that are coupled together. For example, the bracket may be formed in two pieces as depicted by dashed line 308 and then welded or otherwise bonded together.

The bracket 304, as described above, utilizes square openings 302, 304 to prevent the rotation of the piece inserted into the square opening 302, 304 with reference to the bracket 204. These openings 302, 304, consequently, may be formed having other non-circular openings that would also prevent rotation. For example, the openings may have a rectangular or hexagonal cross-section. In an alternative embodiment, the openings 302, 304 may be circular.

Figure 4:
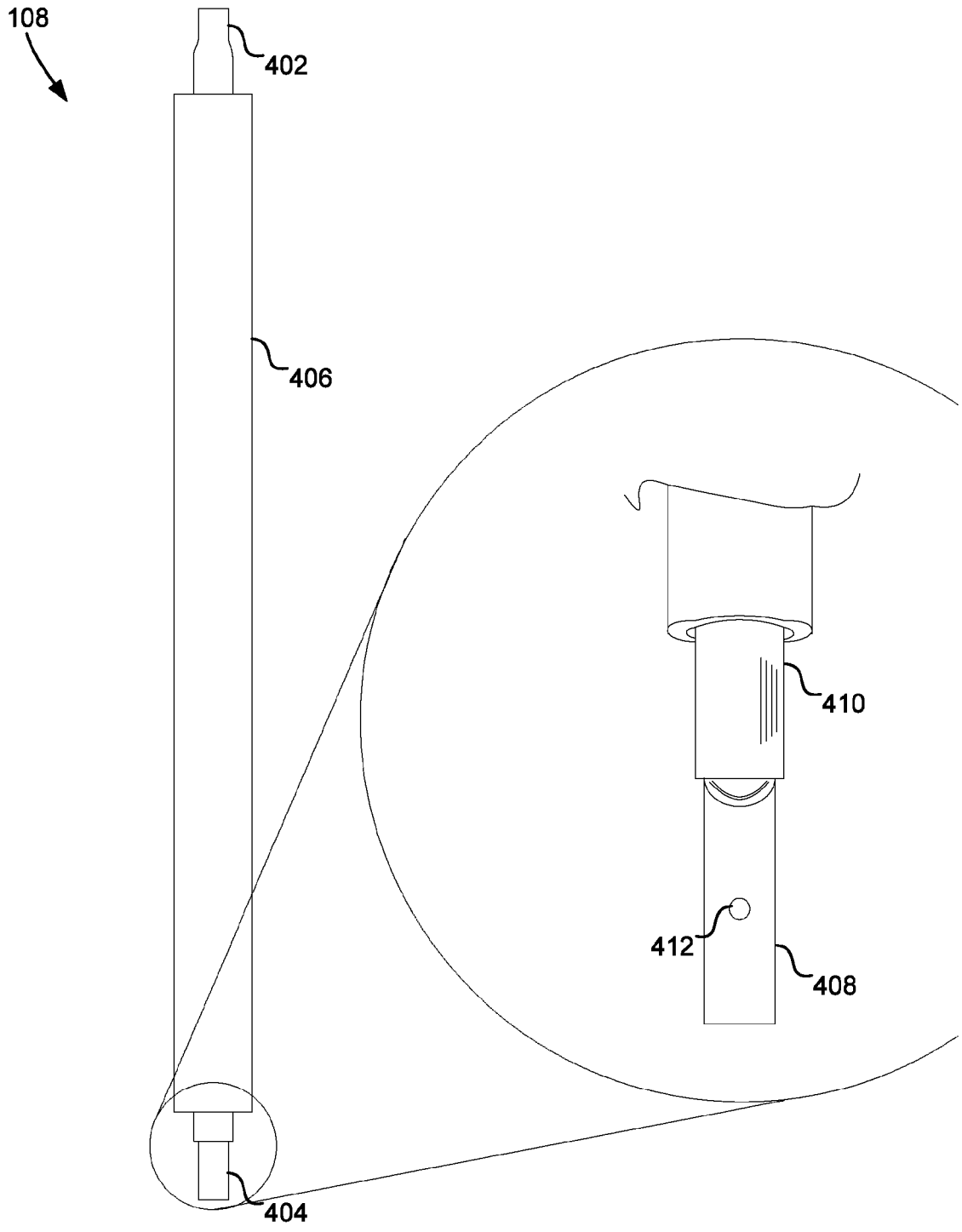
FIG. 4 is a side view illustrating an enclosure pole.

FIG. 4 is a side view diagram illustrating one embodiment of an enclosure pole 108. The enclosure pole 108, as described above with reference to FIG. 1, inserts into an opening on the inside of the frame 104. In other words, the enclosure pole 108 inserts inside the circular frame 104, unlike many common enclosure poles that attach to the outside of the frame. The enclosure pole 108, as depicted, is an elongated pole having opposing ends 402, 404. The opposing ends 402, 404 may be tapered or stepped to form a male portion for inserting into a corresponding opening in either the bracket 204 of FIG. 2, or an adjacent section of the enclosure support (see FIG. 5).

In one embodiment, a protective foam covering 406 encircles the enclosure pole 108. The foam covering 406 protects a user who unintentionally comes in contact with the enclosure pole 108. The foam covering 406 may be formed of polyurethane foam covered by a nylon cover, for example. One skilled in the art will recognize, however, the many different foams and covers that may suitably be used to protect a user of the trampoline.

As depicted, at least one end 404 of the enclosure pole 108 is formed with a square end 408. The enclosure pole 108, in one embodiment, is formed with a tubular portion 410 adjacent the square end 408. When inserted into the square opening 304 of FIG. 3 the enclosure pole 108 does not rotate with reference to the trampoline frame. This allows the enclosure pole to maintain tension on enclosure 110 of FIG. 1. In other words, if the enclosure pole 108 rotated, the enclosure pole 108 and the offset 112 would not be able to maintain the tension of the enclosure 110 that stretches the enclosure 110 between the enclosure poles 108 and prevents users from falling off the trampoline.

In a further embodiment, the square end 408 includes an opening 412 for securing the enclosure pole 108 inside the bracket 204 of FIG. 3. For example, a bolt or other fastening device may pass through the bracket 204 and the opening 412 to secure the enclosure pole 108 and prevent vertical movement.

Figure 5A:
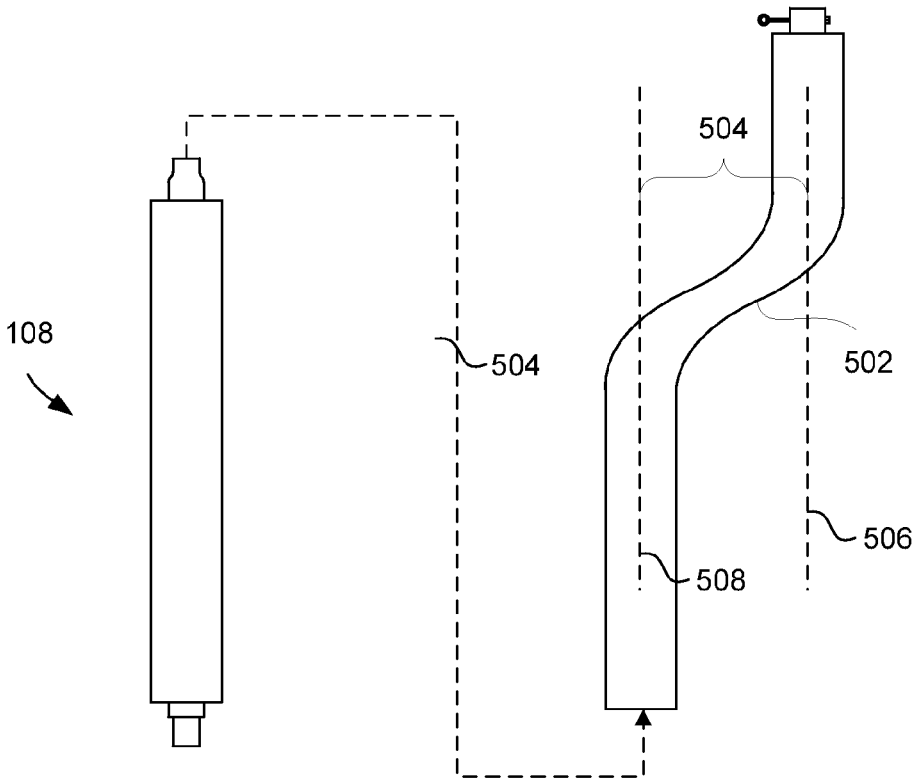
FIGS. 5*a* and 5*b* are a side view illustrating alternative embodiments of an offset pole, one embodiment having a dogleg bend and another embodiment having a gradual curve.
Figure 5B:
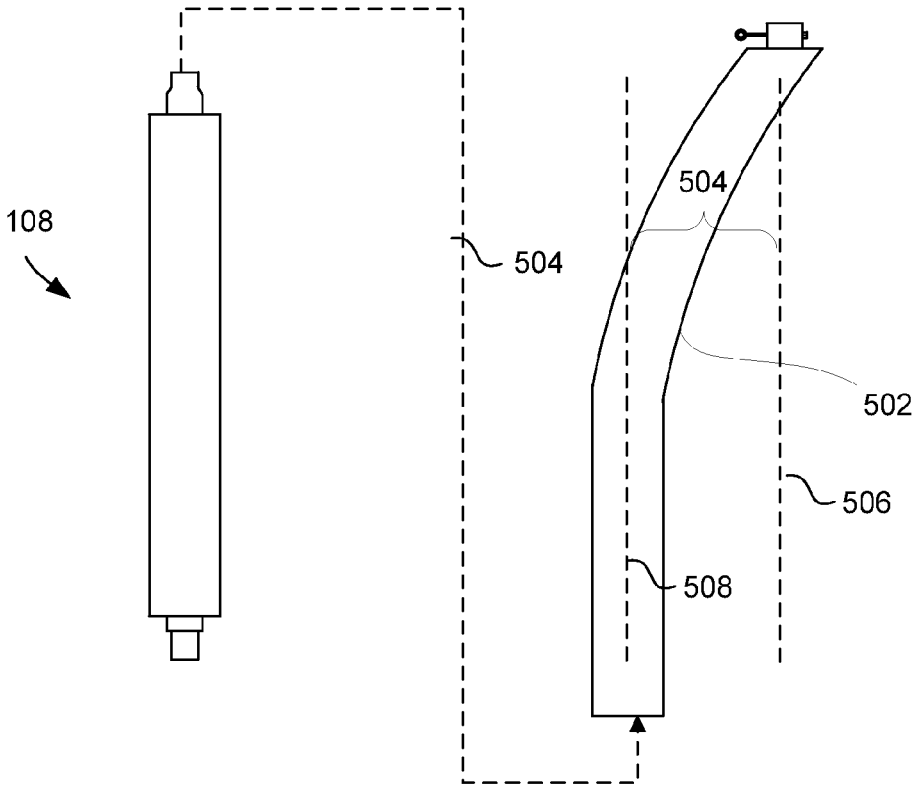

FIGS. 5*a* and 5*b* are side view diagrams illustrating further embodiments of the enclosure pole 108. The enclosure pole 108, as described above, couples with an offset pole 502, having an outward curve, examples of which include a gradual curve 502*b* and a dogleg bend 502*a*. The end 402 of the enclosure pole 108, in one embodiment, is formed as a male portion insertable into the offset pole 502 as indicated by the dashed line 504. Like end 404, end 402 also prevents rotation of the offset pole 502 with reference to the enclosure pole 108. Although depicted as two distinct poles, the enclosure pole 108 and the offset pole 502 may be a single pole of sufficient length. However, packaging the trampoline system of FIG. 1 in a manageable container for shipping is accomplished by providing separated enclosure poles 108 and offset poles 502.

The offset 504 is in the range of between about 2 and 20 inches. In a further embodiment, the offset 504 is in the range of between about 4 and 8 inches. In yet another embodiment, the offset 504 is 6 inches. As used herein, the term offset refers to the perpendicular distance between the longitudinal axis 506 of an upper portion of the offset pole 502 and the longitudinal axis 508 of a lower portion of the offset pole, as illustrated by dashed lines 506, 508, respectively.

Figure 6:
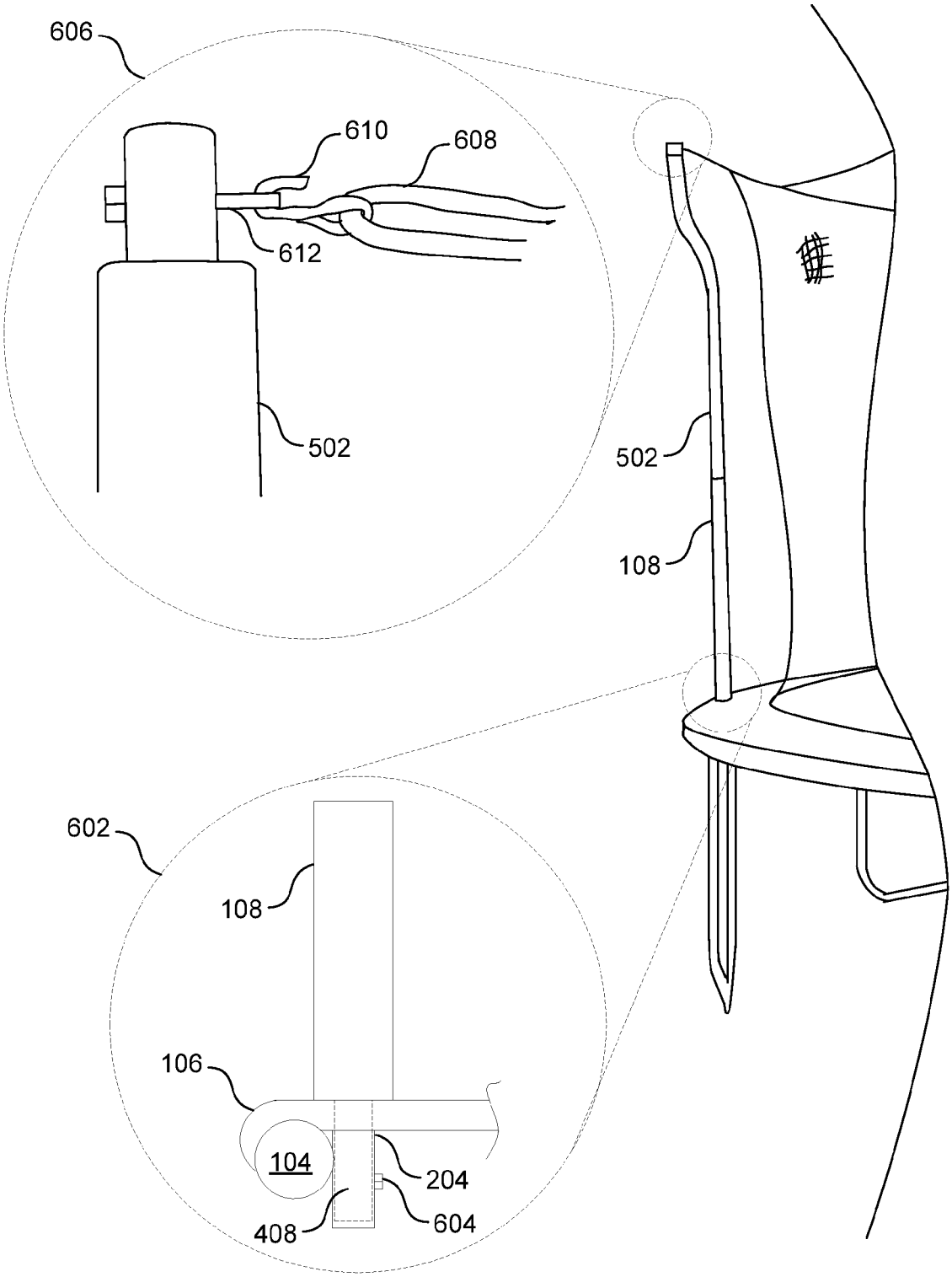
FIG. 6 is a perspective view illustrating an embodiment of the enclosure pole and the offset pole.

FIG. 6 is a perspective view diagram illustrating an embodiment of the enclosure pole 108 and the offset pole 502. FIG. 6 illustrates two zoomed in views of the trampoline system 100 of FIG. 1. The first zoomed in view 602 is a cross-sectional view of the enclosure pole 108 as inserted into the bracket 204 of FIG. 2. As described above, the enclosure pole 108 passes through an opening in the protective pad 106 and inserts into the bracket 204. The enclosure pole 108, as depicted, is located on the inside of the frame 104. A fastening device 604 may secure the square end 408 of the enclosure pole 108 to the bracket 204, thereby securing the protective pad 106.

In one embodiment, the protect pad 106 is held in place because the foam covering of the enclosure pole 108 has an equivalent diameter to the opening through which the enclosure pole 108 passes. Alternatively, the tubular portion of the enclosure pole has a greater diameter than the opening in the protective pad 106 through which the square end 408 passes.

FIG. 6 also depicts a zoomed in view of an enclosure 110 attachment 608. In one example, the enclosure 110 is secured to the offset pole 502 by a flexible cord 608 and an s-hook 610. The flexible cord 608 may be formed of a shock or elastic cord that contains one or more elastic strands. As such, the flexible cord 608 is capable of absorbing movement of the enclosure 110. For example, if a person accidentally falls into the enclosure 110, the flexible cords 608 absorb the stretching and moving of the enclosure 110, and eventually rebound to a default position that evenly stretches the enclosure between all of the enclosure and offset poles. An s-hook 610 couples the flexible cord 608 to a connecting mechanism on the offset pole 502. In the depicted embodiment, the connecting mechanism is an eyebolt 612 that is connected to the offset pole 502.

Figure 7:
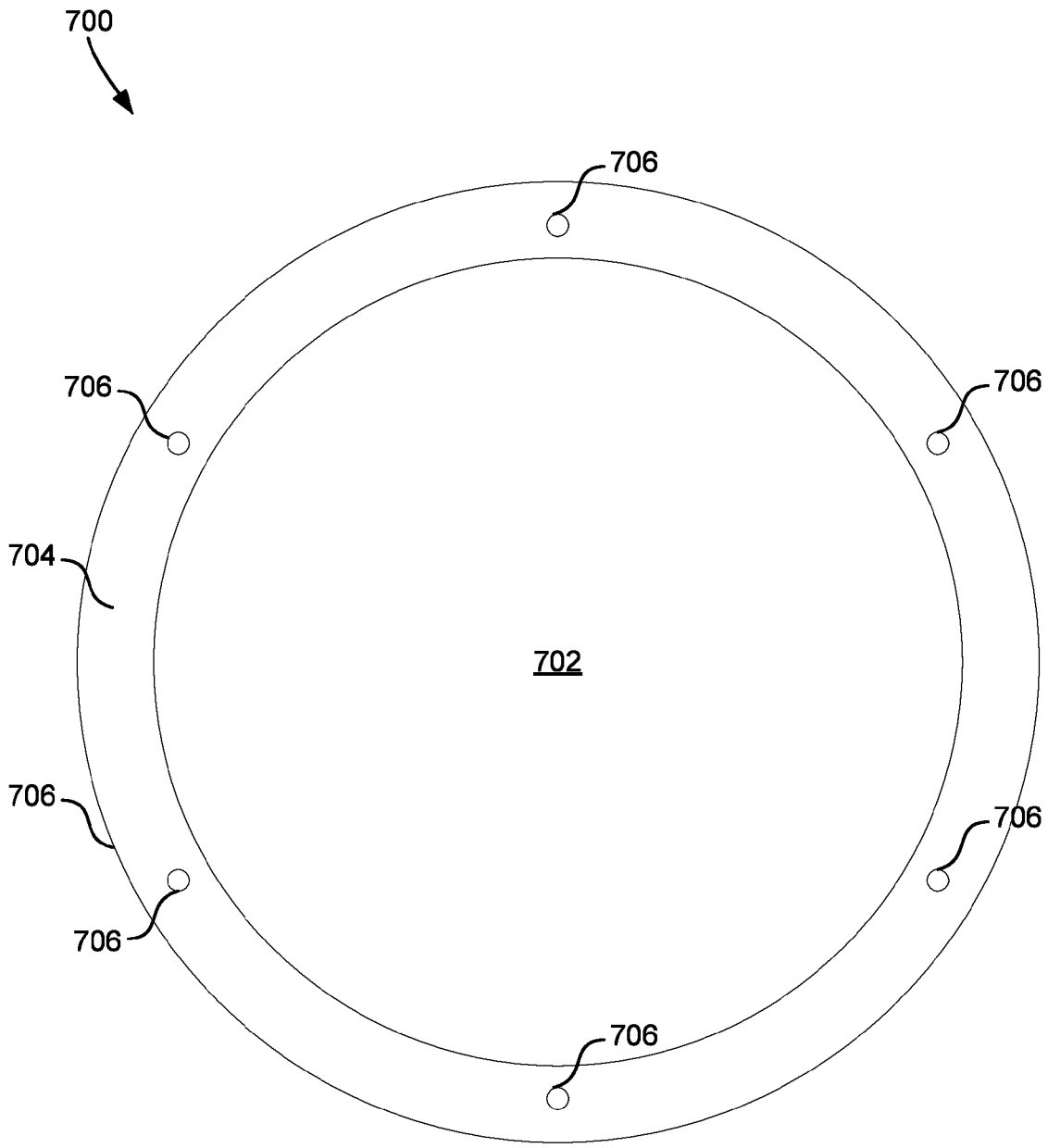
FIG. 7 is a top view perspective illustrating one embodiment of a trampoline in accordance with the present invention.

FIG. 7 is a top view diagram illustrating one embodiment of the trampoline 700. The trampoline 700, as described above, is formed of the rebounding mat 702, the protective pad 704, and the frame (not shown here). The rebounding mat 702, as depicted, may be circular or alternatively, may be other polygonal shapes including, but not limited to, squares, rectangles, and hexagons. The protective pad 704 includes multiple openings 706 positioned radially around the protective pad 704 for receiving the enclosure poles. The openings are positioned to correspond with respective brackets (see FIG. 3). In one example, the protective pad 704 includes six openings. Alternatively, the protective pad 704 may include as many openings as enclosure poles, which are determined according to the size of the enclosure that will be stretched between the enclosure poles, but may include either an even or odd number of enclosure poles.

Figure 8:
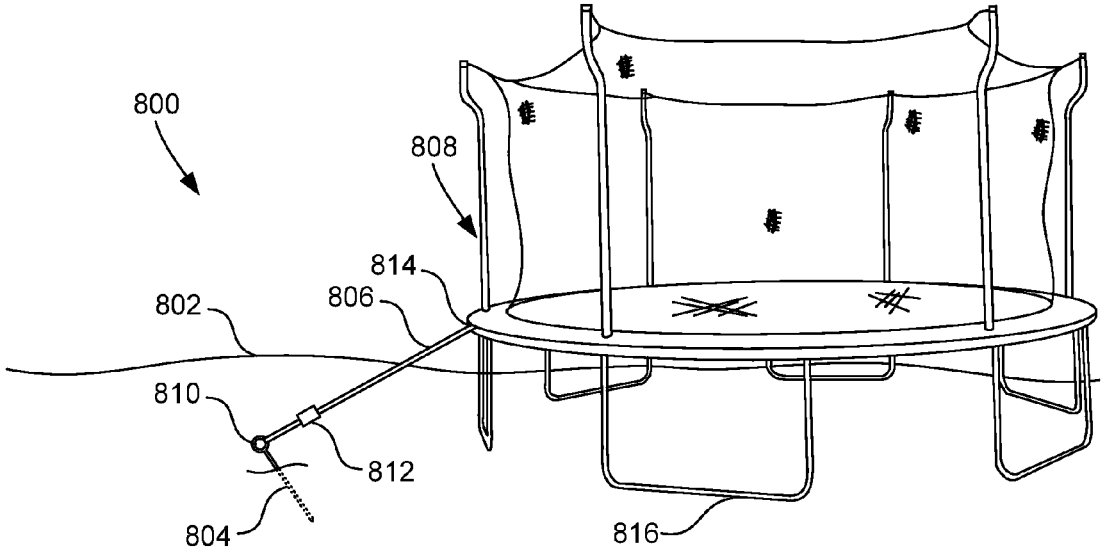
FIG. 8 is a perspective view illustrating one embodiment of a trampoline retention system.

FIG. 8 is a perspective view diagram illustrating one embodiment of a trampoline retention system 800. The retention system 800 maintains the position of the trampoline with reference to the ground 802. The retention system 800 includes an elongated anchor 804 embedded in the ground 802, and a strap 806 connecting the anchor 804 to the trampoline 808.

The anchor 804, in one embodiment, is formed of a substantially rigid material that is capable of being inserted into the ground 802. As the anchor 804 will most likely be "pounded" into the ground 802 by a hammer, for example, the anchor 804 is formed of a corrosion-resistant metal material, such as stainless steel. The anchor 804, in one example, is formed having a length in the range of between about 12 and 24 inches. In another embodiment, the anchor 804 is formed having a length of between about 14 and 18 inches. Alternatively, the anchor is 16 inches long.

The anchor 804 may be formed with an "eye" opening 810 for receiving the strap 806. The strap 806 is formed of a high-tensile strength, and substantially non-stretchable, material. For example, the strap 806 may be formed of a high-strength nylon. The strap 806 also includes an adjustment device 812 for adjusting the tension of the strap 806 between the trampoline 808 and the anchor 804. In a further embodiment, the adjustment device 812 may include a buckle for easy removal of the strap 806.

The strap 806 connects with the upper portions of the frame 814 of the trampoline 808. Unlike many common retention systems that connect to the base 816 of the trampoline, the strap 806 connects with the curved portions of the frame 814 to provide a better leverage angle. Although FIG. 8 illustrates a single retention system 800, multiple retention systems 800 may be positioned around the trampoline. For example, two or more retention systems 800 may extend radially outward from the frame 814 at intervals selected by the user of the trampoline.

Figure 9:
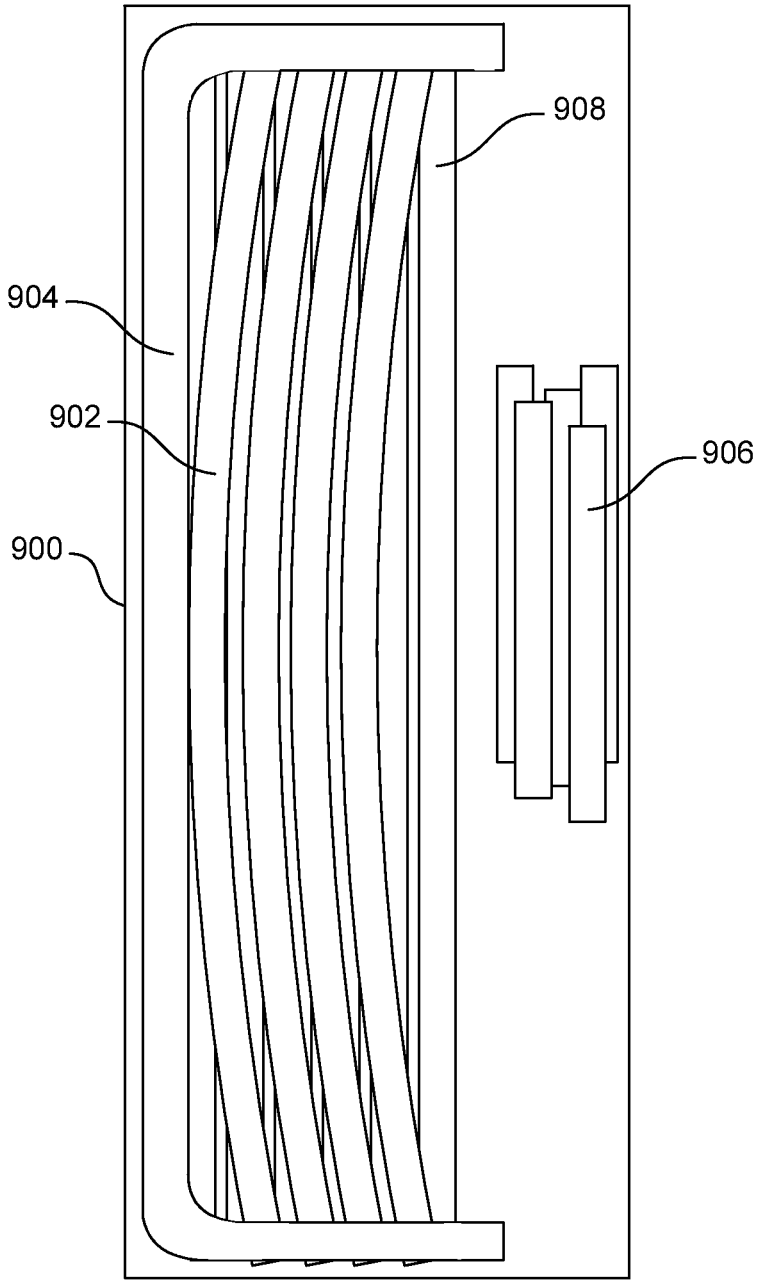
FIG. 9 is a top view illustrating a first layer of the packaged trampoline in a container.
Figure 10:
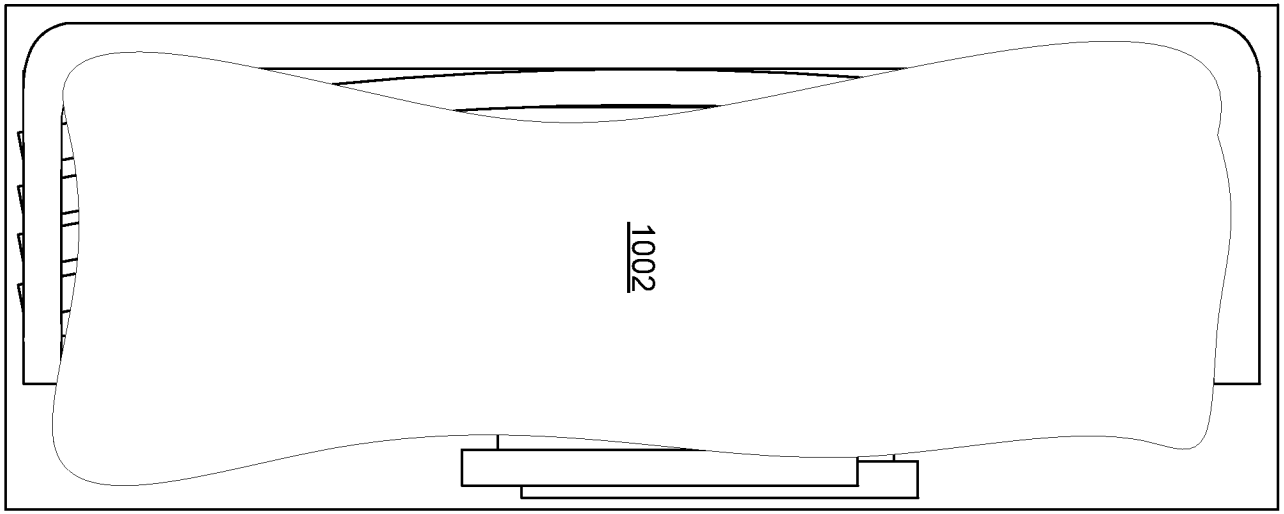
FIG. 10 is a top view illustrating a second layer of the packaged trampoline in a container.
Figure 11:
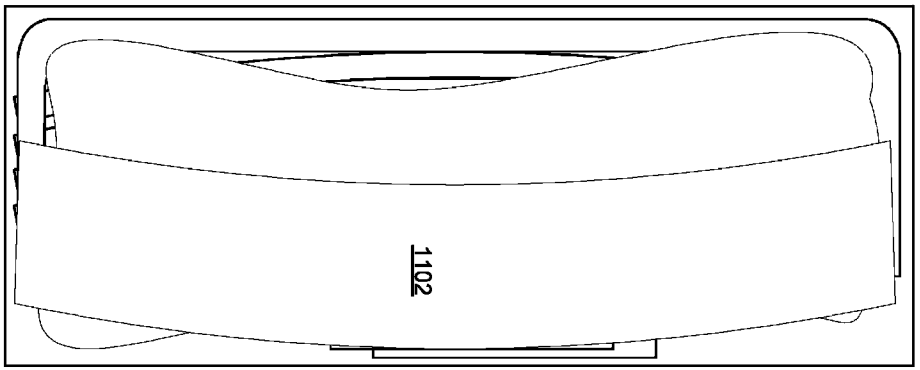
FIG. 11 is a top view illustrating a third layer of the packaged trampoline in a container.

FIGS. 9, 10, and 11 are top view diagrams illustrating one method of packing the trampoline system as described above in a container 900 capable of being shipped on a pallet. The container 900, in one embodiment, has dimensions of about 20 inches wide and about 48 inches long. As such, two containers 900 may be stacked side-by-side on a 40 inch by 48 inch pallet. This is accomplished because the components have been designed to pack compactly inside the container 900.

FIG. 9 illustrates a first layer of the container, which may include a plurality of sublayers. The first sublayer may contain a plurality of circular frame tubes 902 with the three way brackets attached and facing upward (not shown). The second sublayer may contain a plurality of upright poles 908. The third sublayer may contain another plurality of circular frame tubes 902 with brackets attached (not shown). The fourth sublayer may contain a plurality of upright poles 908. The final sublayer may contain a plurality of leg center tubes 904. FIG. 10 illustrates a second layer comprising the rebounding mat 1002 that covers the components described above. Finally, FIG. 11 illustrates another layer that includes the protective pad 1102. In one example, the protective pad 1102 is a unitary ring of padding that is folded to fit into the container 900. Alternatively, the protective pad 1102 is formed of individual curved portions, as depicted, that may be attached to each other to form the protective pad as depicted above with reference to FIG. 7.

Figure 12:
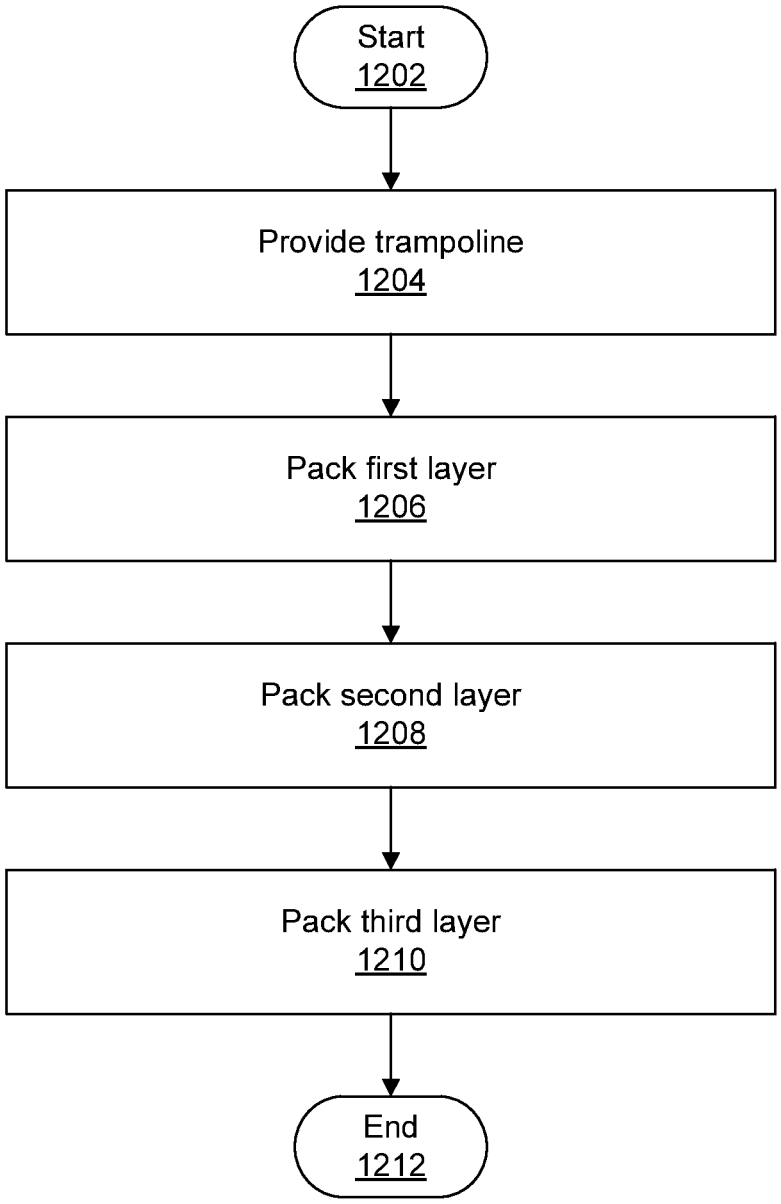
FIG. 12 is a schematic block diagram illustrating one embodiment of a method for packaging a trampoline.

FIG. 12 is a schematic flow chart diagram illustrating one embodiment of a method 1200 for providing a trampoline. The method 1200 starts 1202 and a trampoline is provided 1204. Providing 1204 a trampoline, in one embodiment, includes providing a trampoline in accordance with the system described above with reference to FIGS. 1-11. The trampoline includes, for example, curved portions connected to leg portions and enclosure poles via a bracket. The enclosure pole includes an offset portion for stretching an enclosure. The trampoline may include any number of enclosure poles as is necessary to support the enclosure and maintain tension on the enclosure.

Each of the components of the trampoline is provided with a dimension capable of fitting inside a container with dimensions of about 20 inches wide and 48 inches long. For example, the curved portions are separable and stackable inside the container. Likewise, the leg center tubes, the straight leg tubes, the enclosure poles, and the offset poles are separable and stackable inside the container. The method 1200 continues and the frame elements are stacked in the container to form the first layer 1206.

The second layer may then be packed 1208. In one example, the second layer includes the rebounding mat, as depicted above with reference to FIG. 10. The third layer is then packed 1210. In one embodiment, packing 1210 the third layer comprises packing the protective pad.

Although described above in a certain order, the first, second, and third layers may be packed in an alternative order as deemed necessary for proper shipment of the trampoline system. The method 1200 then ends 1212.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:
a circular frame;
a rebounding mat attached to the circular frame by a plurality of springs;
a net;
an upright pole for connecting to the net, the upright pole having a top end and a bottom end, the upright pole terminating at the top end and being configured to connect to a frame of a trampoline at the bottom end;
a connecting mechanism on the top end for connecting to the net; and
an elastic cord attached to the connecting mechanism and configured to be connected directly between the connecting mechanism and the net.

2. The apparatus of claim 1, further comprising a bracket having openings for receiving the upright pole, a plurality of curved frame tubes, and a leg tube.

3. The apparatus of claim 2 further comprising a protective pad having an opening sized to allow the upright pole to pass through such that the enclosure pole prevents movement of the protective pad.

4. The apparatus of claim 1, wherein the upright pole further comprises a square connector portion on the bottom end.

5. The apparatus of claim 2, wherein the bracket has an opening for receiving the upright pole interior to the curved frame tubes.

6. The apparatus of claim 1, wherein the upright pole is curved outward.

7. The apparatus of claim 1, wherein the upright pole has a dogleg bend near the top end.

8. The apparatus of claim 1, wherein the connecting mechanism comprises an eyebolt and a nut.

9. A trampoline comprising:
a circular frame;
a rebounding mat attached to the circular frame by a plurality of springs;
a protective pad attached to the circular frame;
a plurality of upright legs attached to the circular frame;
a connecting mechanism on the circular frame for receiving an upright pole;
a net;
an upright pole for connecting to the net, the upright pole having a top end and a bottom end, the upright pole terminating at the top end and being configured to connect to a frame of a trampoline at the bottom end;
a connecting mechanism on the top end for connecting to the net; and
an elastic cord attached to the connecting mechanism and configured to be connected directly between the connecting mechanism and the net.

10. The trampoline of claim 9, further comprising a bracket having openings for receiving the upright pole, a plurality of curved frame tubes, and a leg tube.

11. The trampoline of claim 10, further comprising a protective pad having an opening sized to allow the upright pole to pass through such that the enclosure pole prevents movement of the protective pad.

12. The trampoline of claim 9, wherein the upright pole further comprises a square connector portion on the bottom end.

13. The trampoline of claim 10, wherein the bracket has an opening for receiving the upright pole interior to the curved frame tubes.

14. The trampoline of claim 9, wherein the upright pole is curved outward.

15. The trampoline of claim 9, wherein the upright pole has a dogleg bend near the top end.

16. The trampoline of claim 9, wherein the connecting mechanism comprises an eyebolt and a nut.

17. A method of use of a trampoline comprising:
providing:
a circular frame;
a rebounding mat attached to the circular frame by a plurality of springs;
a protective pad attached to the circular frame;
a plurality of upright legs attached to the circular frame;
a connecting mechanism on the circular frame for receiving an upright pole;
a net;
an upright pole for connecting to the net, the upright pole having a top end and a bottom end, the upright pole terminating at the top end and being configured to connect to a frame of a trampoline at the bottom end;
a connecting mechanism on the top end for connecting to the net;
an elastic cord attached to the connecting mechanism and configured to be connected directly between the connecting mechanism and the net; and
assembling the components into a trampoline.

18. A method of claim 17, further comprising packaging the components in a container arranged with a plurality of layers comprising:

a bottom layer comprising a plurality of circular frame tubes with brackets attached facing upward;

an intermediate layer comprising a plurality of upright poles;

an intermediate layer comprising a plurality of circular frame tubes with brackets attached facing upward;

an intermediate layer comprising a plurality of upright poles; and a top layer comprising a plurality of leg supports.

19. A method of claim 18, wherein the leg supports face sideways and partially surround a plurality of soft components comprising:

a rebounding mat;

a protective pad; and a net.

20. A method of claim 19, wherein the dimensions of the container are less than about 20 inches wide and less than about 40 inches long.

* * * * *